US006913544B2

(12) United States Patent
Tiffin

(10) Patent No.: US 6,913,544 B2
(45) Date of Patent: Jul. 5, 2005

(54) DIVOT PRACTICE MAT

(75) Inventor: Richard Tiffin, Santa Cruz, CA (US)

(73) Assignee: The Tiffin Company, Inc., Santa Cruz, CA (US)

( * ) Notice: Subject to any disclaimer, the term of this patent is extended or adjusted under 35 U.S.C. 154(b) by 0 days.

(21) Appl. No.: 10/039,326

(22) Filed: Nov. 7, 2001

(65) Prior Publication Data

US 2003/0087708 A1 May 8, 2003

(51) Int. Cl.[7] ..... A63B 69/36
(52) U.S. Cl. ..... 473/278; 473/257
(58) Field of Search ..... 473/225–227, 473/270, 278, 257, 237, 330, FOR 186.4, 195 R, 183.1

(56) References Cited

U.S. PATENT DOCUMENTS

| | | | | | |
|---|---|---|---|---|---|
| 2,090,348 | A | | 8/1937 | Ferry | |
| 2,660,436 | A | * | 11/1953 | Grossman | 473/237 |
| 2,995,376 | A | | 8/1961 | Leo | |
| 3,311,377 | A | | 3/1967 | Holbus | |
| 3,687,459 | A | | 8/1972 | Swords | |
| 3,754,764 | A | * | 8/1973 | Manheck | 473/237 |
| 3,791,314 | A | * | 2/1974 | Berretta | 108/43 |
| 3,992,013 | A | | 11/1976 | Golden | |
| 4,932,662 | A | * | 6/1990 | Blaisdell | 473/237 |
| 5,028,052 | A | * | 7/1991 | Miller | 473/278 |
| 5,033,215 | A | * | 7/1991 | Newberry et al. | 40/107 |
| 5,033,746 | A | * | 7/1991 | Jones | 473/237 |
| 5,120,064 | A | | 6/1992 | Cerami | |
| 5,142,309 | A | * | 8/1992 | Lee | 473/237 |
| 5,273,285 | A | * | 12/1993 | Long | 473/278 |
| 5,577,967 | A | * | 11/1996 | Durso | 473/145 |
| 5,609,530 | A | | 3/1997 | Butler, Jr. | |
| 5,620,376 | A | | 4/1997 | Hsu | |
| 5,688,190 | A | * | 11/1997 | Rowland et al. | 473/330 |
| 5,690,561 | A | * | 11/1997 | Rowland et al. | 473/330 |
| 5,803,826 | A | * | 9/1998 | Perrine | 473/278 |
| 5,984,802 | A | * | 11/1999 | Perrine | 473/278 |
| 6,155,931 | A | * | 12/2000 | Perrine | 473/278 |
| 6,312,344 | B1 | * | 11/2001 | Smith | 473/237 |
| 6,387,013 | B1 | * | 5/2002 | Marquez | 482/23 |

OTHER PUBLICATIONS

Lawrence Robinson & James Graham,Golfer's Digest book, 1966, Golfer's Digest Association, first anniversary de luxe edition cover page, p. 54, and p. 214.*

* cited by examiner

*Primary Examiner*—Gregory Vidovich
*Assistant Examiner*—Nini F. Legesse
(74) *Attorney, Agent, or Firm*—Michael A. Guth

(57) ABSTRACT

A golf or divot practice mat, comprising a base element and a mark retaining surface operably secured or mounted to the base element. The mark retaining surface may be a no carbon required paper, carbon paper, or wax containing surface, and has one or more simulated golf balls imprinted thereon. The mark retaining surface may be secured to the base element by dowels, adhesives, hook and loop fastening material, or other fastening mechanism. A mark is left on the mark retaining surface from contact with the golf club head, which instantly records and characteristics a golf swing, position, and angle of contact with the simulated golf ball.

19 Claims, 2 Drawing Sheets

DIVOT PRACTICE MAT

BACKGROUND OF THE INVENTION

37 C.F.R. 1.77(a)(7)

1. Field of Invention

This invention relates to golf or divot practice mats, and more particularly to a golf and divot practice mat with an impression retaining surface having one or more images of a golf ball printed or otherwise illustrated thereon.

2. Description of the Related Art

Heretofore a wide variety of golf and golf related practice devices have been proposed and developed for improving golf skills. Prior devices have attempted to provide such practice tools in a variety of different manners. A significant limitation of all prior devices however, is that such devices are often cumbersome, expensive, unreliable, and not particularly convenient for improving golf skills.

The present invention provides a golf or divot practice mat that is convenient to use, reliable, inexpensive to manufacture, and may be used either inside or outside. The divot mat of the present invention is easy to use, and provides instant and reliable feedback on a users golf swing by leaving a mark on a simulated golf ball imprinted on a paper or other impressionable surface. The mark which remains on the paper gives immediate information to the user as to the quality and characteristic of the swing, and guides the user to make better contact with a golf ball.

Although various types of golf practice devices are known in the prior art, none are directed to a mat having a surface with simulated printed golf balls which are marked by the swing of a golf club by the user, thereby indicating instantly the direction and character of the swing.

The present invention provides a golf or divot practice mat which is highly efficient at training a user to be a better golfer. The golf or divot practice mat of the present invention may be used successfully by beginning golfers, intermediate level golfers, or expert golfers at any location, either inside or outside, without the need of any other equipment or accessories.

Accordingly, it is the primary object of this invention to provide a divot or golf practice mat with an impressionable surface having one or more imprinted simulated golf balls thereon. The impressionable surface is preferably composed of a no carbon required (NCR) type paper, but may alternatively be composed of or contain a wax, a carbon paper, or the like.

Additional objects and advantages of the invention will be set forth in the description which follows, and in part will be obvious from the description, or may be learned by practice of the invention. The objects and advantages of the invention may be realized and obtained by means of the instrumentality's and combinations particularly pointed out in the appended claims

BRIEF SUMMARY OF THE INVENTION

37 C.F.R. 1.77(a)(8)

The present invention is a golf or divot practice mat, comprising a base element and a mark retaining surface operably secured or mounted to the base element. The mark retaining surface may be a no carbon required paper, carbon paper, or wax containing surface, and has one or more simulated golf balls imprinted thereon. The mark retaining surface may be secured to the base element by dowels, adhesives, hook and loop fastening material, or other fastening mechanism. A mark is left on the mark retaining surface which instantly records and characterizes a golf swing, position, and angle of contact with the simulated golf ball. The practice mat may be conveniently used anywhere, indoors or outdoors.

BRIEF DESCRIPTION OF THE DRAWINGS

The accompanying drawings, which are incorporated in and constitute a part of the specification, illustrate a preferred embodiment of the invention and, together with a general description given above and the detailed description of the preferred embodiment given below, serve to explain the principles of the invention.

DETAILED DESCRIPTION OF THE INVENTION

37 C.F.R. 1.77(a)(10)

Reference will now be made in detail to the present preferred embodiments of the invention as illustrated in the accompanying drawings.

In accordance with the present invention, there is provided a golf or divot practice mat, comprising a base element and a mark retaining surface operably secured or mounted to the base element. The mark retaining surface may be a no carbon required (NCR) paper, carbon paper, or wax containing surface, and has one or more simulated golf balls imprinted thereon. The mark retaining surface may be secured to the base element by dowels, adhesives, hook and loop fastening material, or other fastening mechanism. A mark is left on the mark retaining surface which instantly records and characteristics a golf swing, position, and angle of contact with the simulated golf ball. This allows the user to be made aware of the quality and characteristics of a swing and be trained accordingly. The practice mat may be safely and conveniently used anywhere, indoors or outdoors.

Figure 1:
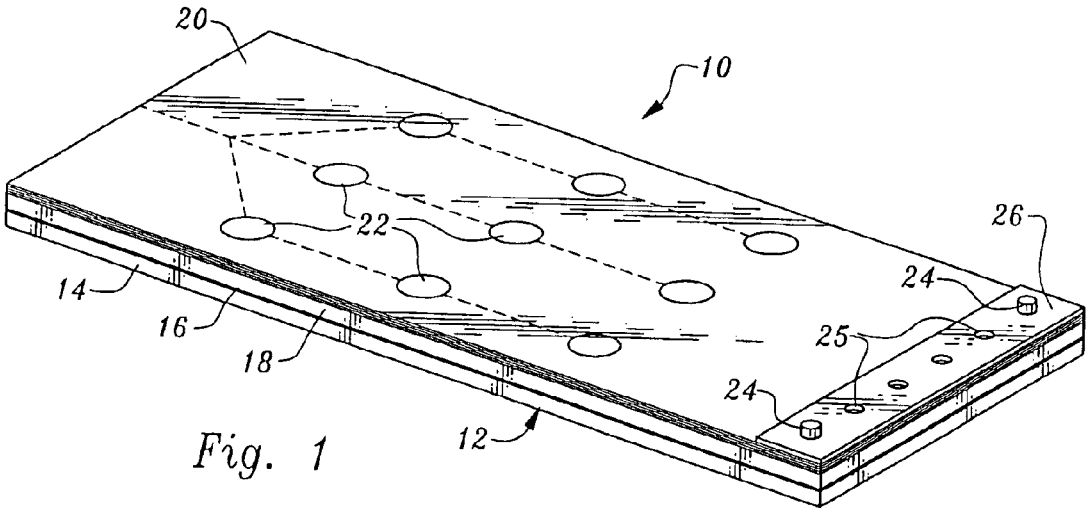
FIG. 1 is a perspective view of a golf or divot practice mat using dowels to secure the mark retaining surface to the base element, according to the invention.

In FIG. 1, the golf or divot practice mat 10, is shown according to a preferred embodiment of the invention. Preferably mat 10, comprises a base element 12, with a rubber mat 14, for preventing slipping or skidding of the mat 10, on a surface. Preferably rubber mat 14, is composed of polyurethane rubber, but other durable resilient materials may also be used such as soft plastics, cloth, composites or the like, and is secured to base element 12, by adhesive printing tape 16, or by adhesives, fasteners such as rivets, screw, dowels, or the like. A sheet of durable resilient material 18, such as polycarbonate plastic, provides a firm support means. However, other durable, resilient materials may also be used, such as composites, rubber, plastics, wood, metal, or the like. Preferably sheet 18, is of a substantially planar configuration, but may be otherwise. For example, it is possible to provide golf and divot practice mat 10, in a non-planar configuration, such as a curved, concave, or convex configuration.

A mark retaining surface means 20, for recording an impression resulting from contact with a golf club head is preferably an impression retaining paper such as no carbon required paper (NCR), wax, carbon paper or the like. On the sureface of mark retaining means 20, are printed or otherwise impressed, images of one or more golf balls.

Retaining means for securing and positioning one or more of sheets of the NCR paper 20, to base element 12, may be provided as one or more dowels 24, with aperture 25, in sheet of durable resilient material, 18. As seen in FIG. 1, a fastening flap 26 of clipboard, composite, plastic, wood, metal, or other durable material may be drilled and used to match dowels 25, and prevent paper 20, from ripping out.

Figure 2:
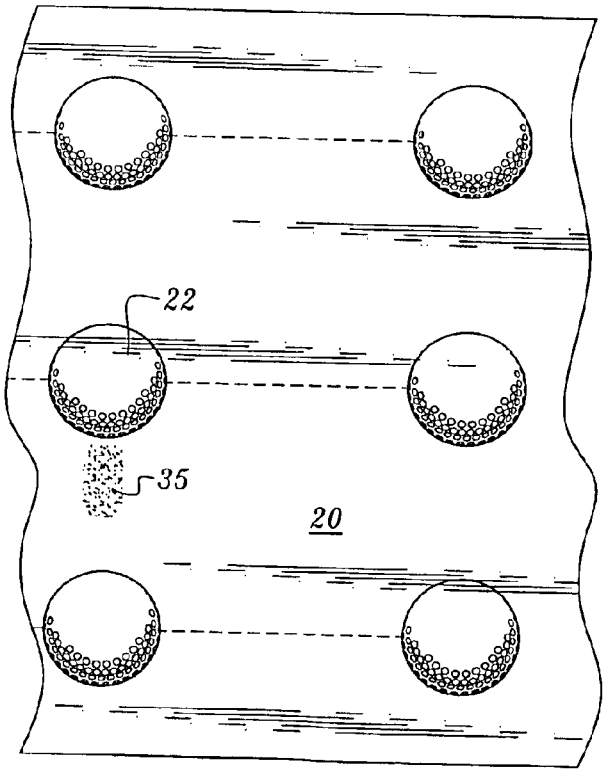
FIG. 2 shows a mark retaining means with a plurality of simulated golf balls imprinted thereon, according to the invention.

In FIG. 2, a mark retaining surface 20, preferably composed of a no carbon required (NCR) paper, is shown with a plurality of simulated golf balls 22 printed thereon. Alternatively, a carbon paper, a wax impregnated surface, or the like may be substituted for NCR paper. Also, if desired, the mark retaining surface may show only one golf ball, or more than one. A mark 35, is immediately made on mark retaining surface by contact with the head or other part of a golf club, and provides immediate insight to the user as to the angle, quality, and characteristic of the swing of the golf club.

Figure 3:
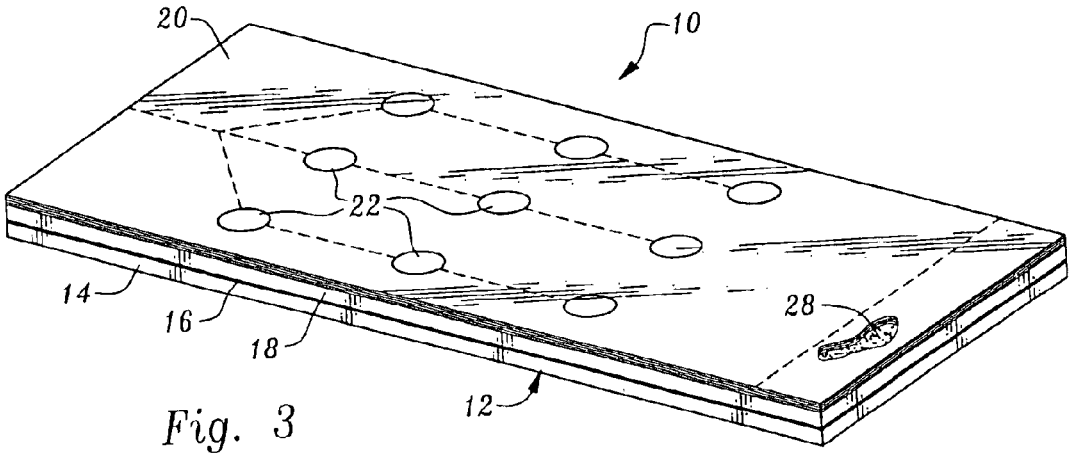
FIG. 3 is a perspective view of a golf or divot practice mat using adhesives to secure the mark retaining surface to the base element, according to the invention.

Referring now to FIG. 3, an alternative embodiment of golf or divot practice mat 1, is shown with an adhesive layer 28, securing the mark retaining surface 20, that is, preferably a plurality of sheets of NCR paper, to base element 12.

Figure 4:
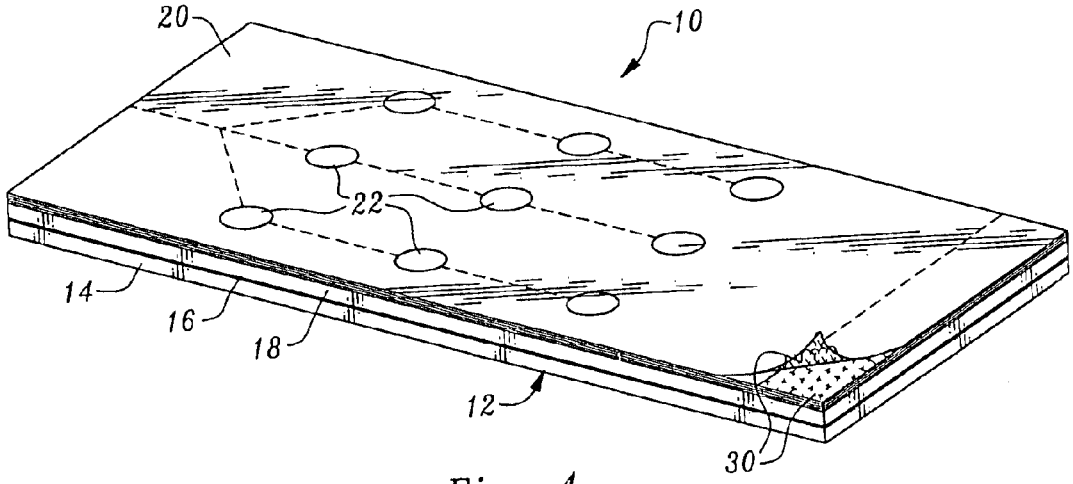
FIG. 4 is a perspective view of a golf or divot practice mat using hook and loop fastening elements to secure the mark retaining surface to the base element, according to the invention.

With reference now to FIG. 4, another embodiment of golf of divot practice mat 10, is shown. In this example, hook and loop fastening elements 30, are used, to secure the plurality of sheets of NCR paper to base element 12.

In operation and use golf or divot practice mat 10, is easy to use, convenient, and very efficient for improving a users golf swing. Golf and divot practice mat 10, may be used indoors or outdoors, and is a very cost effective practice means. To use golf and divot practice mat 10, the user simply places the mat on a suitable surface, such as a floor, a deck, a lawn, or the like, and commences practice. The used sheets of NCR paper or other mark retaining surface, may be kept as a record and compared with later sheets to note improvement.

As is evident from the above description, a wide variety of bags may be configured for may different applications from the description given herein and additional advantages and modifications will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. A golf practice mat comprising:

a firm support layer;

mark retaining surface means for recording an impression resulting from contact with a golf club head; and retaining means for securing and positioning one or more of said mark retaining means to said firm support layer, wherein the mark retaining surface means substantially extends to the peripheral edges of the firm support layer, wherein said mark retaining means comprise a sheet of no carbon required paper having one or more simulated golf balls thereon, and a rubber mat operably secured to said firm support layer, wherein said rubber mat underlies said firm support layer.

2. A golf practice mat comprising:

a firm support layer;

mark retaining surface means for recording an impression resulting from contact with a golf club head; and retaining means for securing and positioning one or more of said mark retaining means to said firm support layer, wherein said retaining surface means comprise a sheet of carbon paper.

3. A golf practice mat comprising:

a firm support layer;

mark retaining surface means for recording an impression resulting from contact with a golf club head;

retaining means for securing and positioning one or more of said mark retaining means to said firm support layer; wherein the mark retaining surface means substantially extends to the peripheral edges of the firm support layer; and a rubber mat operably secured to said firm support layer, wherein said rubber mat underlies said firm support layer, wherein said mark retaining surface means is adapted to be easily removed and replaced, and wherein said mark retaining means is adapted to retain marks after removal.

4. The golf practice mat of claim 3, wherein said rubber mat is secured to said firm support layer by adhesive tape.

5. The golf practice mat of claim 3, wherein said rubber mat is secured to said firm support layer by adhesives.

6. The golf practice mat of claim 3, wherein said firm support layer comprises a substantially planar sheet of plastic.

7. The golf practice mat of claim 6, wherein said substantially planar sheet of plastic is a sheet of polycarbonate plastic.

8. The golf practice mat of claim 3, wherein said mark retaining means comprise a sheet of no carbon required paper having one or more simulated golf balls thereon.

9. The golf practice mat of claim 3, wherein said retaining surface means comprise a sheet of carbon paper.

10. A golf practice mat comprising:

a firm support layer;

mark retaining surface means for recording an impression resulting from contact with a golf club head;

retaining means for securing and positioning one or more of said mark retaining means to said firm support layer; wherein the mark retaining surface means substantially extends to the peripheral edges of the firm support layer; and a rubber mat operably secured to said firm support layer, wherein said rubber mat underlies said firm support layer, wherein said mark retaining surface means is adapted to be easily removed and replaced, and wherein said mark retaining means is adapted to retain marks after removal, and wherein said firm support layer is significantly more rigid than said mark retaining layer.

11. The golf practice mat of claim 10, wherein said rubber mat is secured to said firm support layer by adhesive tape.

12. The golf practice mat of claim 10, wherein said rubber mat is secured to said firm support layer by adhesives.

13. The golf practice mat of claim 10, wherein said firm support layer comprises a substantially planar sheet of plastic.

14. The golf practice mat of claim 13, wherein said substantially planar sheet of plastic is a sheet of polycarbonate plastic.

15. The golf practice mat of claim 10, wherein said mark retaining means comprise a sheet of no carbon required paper having one or more simulated golf balls thereon.

16. The golf practice mat of claim 10, wherein said retaining surface means comprise a sheet of carbon paper.

17. A golf practice mat comprising:

a firm support layer, wherein said firm support layer is substantially rectangular;

mark retaining surface means for recording an impression resulting from contact with a golf club head, said mark retaining surface means overlaying said firm support layer;

retaining means for securing and positioning said mark retaining means to said firm support layer, wherein said retaining means secures said mark retaining means to said firm support layer substantially along one edge of the substantially rectangular shape; wherein the mark retaining surface means substantially extends to the peripheral edges of the firm support layer; and a rubber mat operably secured to said firm support layer, wherein said rubber mat underlies said firm support layer, wherein said mark retaining surface means is adapted to be easily removed and replaced.

18. The golf practice mat of claim 17 wherein said mark retaining means is adapted to be removed without damage to the portion of said mark retaining means which has recorded impressions from contact with a golf club head.

19. The golf practice mat of claim 18 wherein said mark retaining means is secured to said firm support layer only along one edge of said substantially rectangular shape.

* * * * *